US007100331B2

(12) United States Patent
Nehring

(10) Patent No.: US 7,100,331 B2
(45) Date of Patent: Sep. 5, 2006

(54) DIRECTIONAL FLOW FLASHING

(76) Inventor: Walter Wayne Nehring, 15802 Panarama Ct., Del Valle, TX (US) 78617

( * ) Notice: Subject to any disclaimer, the term of this patent is extended or adjusted under 35 U.S.C. 154(b) by 0 days.

(21) Appl. No.: 10/159,641

(22) Filed: Jun. 3, 2002

(65) Prior Publication Data

US 2003/0221375 A1 Dec. 4, 2003

(51) Int. Cl.
*E04F 17/00* (2006.01)

(52) U.S. Cl. ..... 52/13; 52/35; 52/62; 52/97; 52/287.1; 52/716.2

(58) Field of Classification Search ..... 52/58, 52/13, 302.6, 287.1, 35, 61, 62, 97, 276, 52/716.2, 630; 404/2; 405/118, 119; 428/169; D25/112, 139, 141
See application file for complete search history.

(56) References Cited

U.S. PATENT DOCUMENTS

| | | | | | |
|---|---|---|---|---|---|
| 317,868 | A | * | 5/1885 | Smith | 52/277 |
| 364,044 | A | * | 5/1887 | Sagendorph | 52/278 |
| 618,074 | A | * | 1/1899 | Dyer | 52/58 |
| 669,148 | A | * | 3/1901 | Smith | 52/276 |
| 1,152,236 | A | * | 8/1915 | Swanson | 52/13 |
| 1,171,662 | A | * | 2/1916 | Russell | 105/410 |
| 1,410,945 | A | * | 3/1922 | Mayfield | 52/521 |
| 1,440,358 | A | * | 12/1922 | Whetstone | 428/169 |
| 1,776,116 | A | * | 9/1930 | Harvey | 29/527.4 |
| 1,976,166 | A | * | 10/1934 | Fricdberg | 52/302.6 |
| 1,986,383 | A | * | 1/1935 | Usinger | 405/120 |
| 1,992,819 | A | * | 2/1935 | Friedberg et al. | 52/302.6 |
| 2,154,734 | A | * | 4/1939 | Doing | 52/302.6 |
| D166,761 | S | * | 5/1952 | Langville | D25/139 |
| 3,124,427 | A | * | 3/1964 | Chomes | 428/603 |
| 3,488,081 | A | * | 1/1970 | Nolen | 296/97.23 |
| 4,033,702 | A | * | 7/1977 | Moerk, Jr. | 404/69 |
| 4,244,761 | A | * | 1/1981 | Remi et al. | 156/71 |
| 4,299,064 | A | | 11/1981 | Daniels | |
| 4,416,835 | A | * | 11/1983 | Bosne | 261/110 |
| 4,449,333 | A | * | 5/1984 | Stratton | 52/13 |
| 4,571,026 | A | | 2/1986 | Maruta | |
| 4,706,427 | A | * | 11/1987 | Zeilinger | 52/257.1 |
| 4,745,716 | A | * | 5/1988 | Kuypers | 52/169.5 |
| 4,837,997 | A | | 6/1989 | Zeilinger | |
| 5,072,552 | A | * | 12/1991 | Sauder | 52/58 |
| 5,115,603 | A | * | 5/1992 | Blair | 52/13 |
| 5,159,723 | A | | 11/1992 | Benedict | |
| 5,203,640 | A | * | 4/1993 | Pourtau et al. | 403/403 |
| 5,435,021 | A | | 7/1995 | Williams | |
| 5,581,959 | A | * | 12/1996 | Occhipinti | 52/58 |
| 5,705,002 | A | * | 1/1998 | Sherry | 156/71 |
| 5,960,596 | A | * | 10/1999 | Lyons, Sr. | 52/200 |
| 5,960,598 | A | * | 10/1999 | Tamlyn | 52/254 |
| 6,122,874 | A | * | 9/2000 | Smerilli | 52/408 |
| 6,138,295 | A | | 10/2000 | Hess | |

(Continued)

OTHER PUBLICATIONS

Sweet's General Building & Renovation 1995 Catalog, pp. 1, 2.*

*Primary Examiner*—Robert Canfield

(57) ABSTRACT

A flashing providing directional vanes, ribbing, scoring or etchings on its working surface which is suitable for joining, or providing backing for, sections of roofing materials, sections of exterior wall material, particularly at corners, and sections of the walls of a bathtub or shower stall and causes accumulated moisture flow to be directed inwardly toward a moisture drainage point for the flashing rather than outwardly toward the surrounding building structure.

1 Claim, 4 Drawing Sheets

U.S. PATENT DOCUMENTS 6,412,229 B1 * 7/2002 Kuhns ..... 52/13
6,758,017 B1 * 7/2004 Young ..... 52/255
2003/0215611 A1 * 11/2003 Seth et al. ..... 428/169

* cited by examiner

DIRECTIONAL FLOW FLASHING

BACKGROUND OF THE INVENTION a. Field of the Invention

The present invention is related generally to the field of flashings used to trim or join two surfaces, for example flashings are used to join the roof tiles of a first story roof to the siding of a second story portion of the same building in order to prevent water and moisture leakage into the structural components of the building and flashings are used to join two sections of roof tiles in order to prevent water and moisture leakage between the tile sections onto the structural components beneath.

More particularly the instant invention is related to apparatus useful in joining sections of liner surrounding a shower stall.

Yet more particularly, the instant invention is related to flashings that prevent water and moisture leakage by controlling the directional flow of water and condensate on the flashing's working surface. Where the flashing's working surface is defined as that surface upon which water and/or moisture accumulates.

Even yet more particularly, the instant invention is related to flashings that provide directional vanes, ribbing or etchings which, together with gravitational effects, provide directional flow of water and condensate on the flashing's working surface.

b. Description of the Prior Art

There are numerous flashings in common usage. Such flashings are commonly utilized to join two surfaces and provide a means for avoiding leakage of moisture to the surface support(s) beneath or behind the two surfaces. Such common applications of flashings include joining two sections of roofing tiles whereby the flashing is placed underneath the edges of each of the two sections of roofing tiles and is intended to prevent moisture from leaking onto and causing rotting of the roof tile subsurface in the region between the two sections of roofing tiles. Another common application of flashings includes joining a building's first story section of roofing tiles to such building's second story wall siding section whereby the flashing is placed underneath the edges of the roofing tiles and behind the siding section and acts, again, to prevent water and moisture from leaking onto and causing rotting of the structural portions of the building. A yet further common application of flashings is the placement of a flashing between two sections of shower liner where the shower liner may be covered with tiling or other ornamental surface and the shower liner serves to protect the building structure from the leakage of moisture through the ornamental surface. No such prior art applications of flashings teach the use of directional vanes, ribbing, scoring or etchings to control the direction of flow of the moisture which accumulates on the flashing's working surface.

U.S. Pat. No. 6,138,295 teaches use of sections of shower wall (liner) to capture moisture which are interior to the building walls and does not provide for any flashing between sections.

U.S. Pat. No. 5,705,002 teaches a molding used to join the surface of a window pane to the surface of a wall. Vertical scoring may be used on the molding to provide easy tear off and adjustment of molding width.

U.S. Pat. No. 5,435,021 teaches the use of a single piece, limp, and flimsy, elastic and extensible polyolefin film attached to the back side of the three vertical sections of a shower stall liner in order to keep moisture from leaking into the building structure.

U.S. Pat. No. 5,203,640 teaches the use of a profiled strip for joining the tiles of two vertical walls. The profiled strip takes the place of a flashing behind two adjacent vertical walls.

U.S. Pat. No. 5,159,723 teaches an improved bathtub wall form which provides a secure means of attaching the bathtub to structural wall members, a flashing that eliminates the bulge where drywall and the upper flashing of the bathtub meet, a means of holding the drywall edge away from the planar surface of the bathtub, and a wall tile groove.

U.S. Pat. No. 4,837,997 teaches a sealing system for sealing the joints formed between the top surface of a tub and two adjoining vertical walls. The sealing system utilizes three L-shaped sealing strips and one corner piece for sealing the corner where the joints meet. Each of the sealing strips, including the corner piece, are adhesively attached to the backs of the three adjoining surfaces formed by the vertical walls and the top surface of the tub.

U.S. Pat. No. 4,299,064 teaches use of a pair of orthogonally disposed flashings terminating in flared, flexible lips for overlapping adjunct edges of the panels which are the vertical walls of a tub surround. Each of the orthogonally disposed flashings provides a physical join, adhesively or otherwise, to the vertical walls making a corner.

All of the prior art patents disclose and teach the use of a vertically positioned L-shape as either the structure of or backing for a corner made by adjoining vertical walls of a tub or shower stall, but none of the known prior art, including the above-mentioned patents, discloses or teaches the use of directional vanes, ribbing, scoring or etchings to control the direction of flow of the moisture which accumulates on the flashing's working surface.

It is well-known and understood that the accumulation of moisture will cause beads of condensation on a vertical sheet, and that those beads of condensation may even form rivulets tending downwardly. However, it is also commonly observed that such rivulets divert momentarily either to the right or to the left in their downward flow. Such diversion, in the event that it intersects the edge of a protective flashing's working surface, will cause leakage into the building structure surrounding the tub or shower.

Accordingly, it is seen that the flashings and methods of joining the vertical walls of the prior art all suffer from a degree of leakage into the building structure surrounding the tub or shower.

SUMMARY OF THE INVENTION

The instant invention is of a flashing which provides on its surface of interest (the working surface) directional vanes, ribbing, scoring or etchings to control the direction of flow of the moisture which accumulates on the working surface of the flashing. A flashing's surface of interest or working surface is the surface upon which moisture collects and which is facing outwardly away from the structural or subsurface components being protected from the moisture by the flashing. The flashing of the preferred embodiment of the instant invention is useful for joining, or providing backing for, sections of roofing materials, sections of exterior wall material, particularly at corners, and sections of the walls of a bathtub or shower stall.

There are numerous potential uses for the flashing of the instant invention. Some additional potential uses can be found in the general application of the instant invention to join sections of materials which are exposed to rain, condensate, or other moisture accumulation and behind which are subsurface materials, perhaps structural materials, which need to be protected from the moisture.

The primary problem in the prior art addressed by the instant invention is that of directing the flow of moisture accumulated on the working surface of a flashing toward the interior of the flashing and away from the outer edges of the flashing whereby leakage of moisture between the two sections of materials being joining or backed by the flashing out into the building structure is avoided. Moisture accumulated on the working surface of a flashing which is permitted to drain or flow over the outer edges of the flashing onto the subsurface or structural materials beneath or behind the flashing creates rot and/or damage to the subsurface or structural materials.

Accordingly, it is an object of the invention to provide a flashing with directional vanes, ribbing, scoring or etchings on the working surface of the flashing whereby moisture is directed toward the interior of the flashing and away from the outer edges of the flashing thereby preventing leakage of moisture out into the building structure or subsurface.

It is a further object of the invention to provide a flashing with directional vanes, ribbing, scoring or etchings on the working surface of the flashing which is inexpensive to manufacture, lightweight, durable and easy to install.

It is a yet further and final object of the invention to provide a flashing with directional vanes, ribbing, scoring or etchings on the working surface of the flashing which when installed in a shower tub directs the flow of moisture into a drain or back into the shower tub and away from the building structure or subsurface surrounding the shower enclosure.

DESCRIPTION OF NUMERIC REFERENCES

10. Working surface of right panel of flashing of instant invention
11. Top of center fold of flashing of instant invention
12. Bottom of center fold of flashing of instant invention
13. Center fold of flashing of instant invention
14. Flashing of instant invention
16*a*. Left hand upper-most directional vane, ribbing, scoring or etching
16*b*. Right hand upper-most directional vane, ribbing, scoring or etching
16*c*. Left hand second upper-most directional vane, ribbing, scoring or etching
16*d*. Right hand second upper-most directional vane, ribbing, scoring or etching
16*e*. Left hand third upper-most directional vane, ribbing, scoring or etching
16*f* Right hand third upper-most directional vane, ribbing, scoring or etching
16*g*. Left hand fourth upper-most directional vane, ribbing, scoring or etching
16*h*. Right hand fourth upper-most directional vane, ribbing, scoring or etching
17. Working surface of left panel of flashing of instant invention
20. Shower tub
21. Top of right hand wall of shower tub
22. Interior of right hand wall of shower tub
23. Floor of shower tub
24. Shower tub drain
25. Interior of left hand wall of shower tub
26. Top of left hand wall of shower tub
30. Left hand panel of vertical wall of shower enclosure
31. Right hand panel of vertical wall of shower enclosure
32. Building second story siding material
34. Building first story roofing material

BRIEF DESCRIPTION OF THE DRAWINGS

While the novel features of the instant invention are set forth with particularity in the appended claims, a full and complete understanding of the invention can be had by referring to the detailed description of the preferred embodiment which is set forth subsequently, and which is as illustrated in the accompanying drawings, in which:

DESCRIPTION OF THE PREFERRED EMBODIMENT(S)

Figure 1:
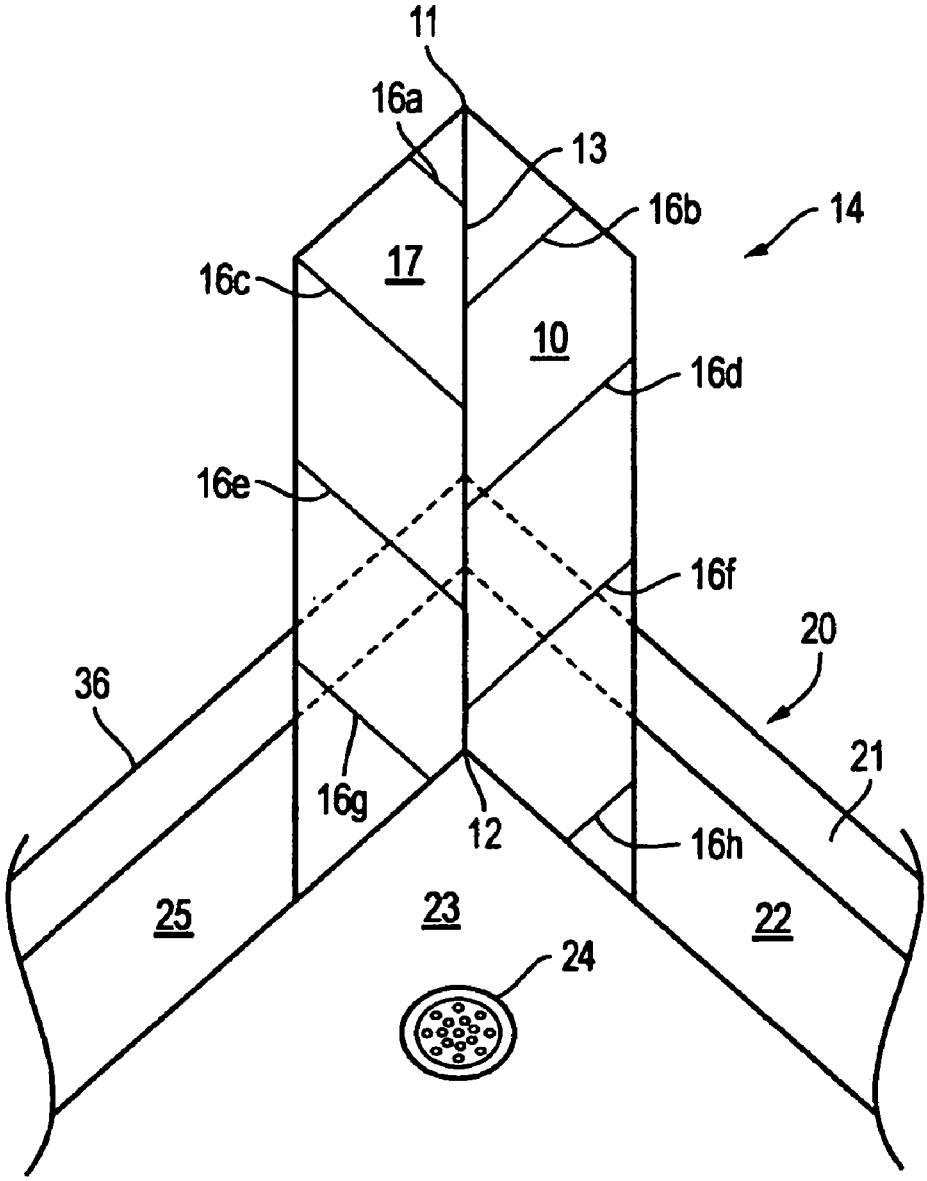
FIG. 1 is a perspective view of the flashing of the instant invention positioned vertically in a shower tub.

As seen in FIG. 1, the instant invention is of a flashing 14 with directional vanes, ribbing, scoring or etchings 16*a*–16*h* on its working surface. In the preferred embodiment, the flashing 14 of the instant invention is of a single piece construction, metal or plastic, with a center fold, line 11–12, whereby two interior surface panels 10 and 17 are discernable. While no specific angle exists between the two working surface panels 10 and 17, in the embodiment depicted in FIG. 1, where the flashing 14 is standing vertically in a corner of a shower tub enclosure 20, such angle approximates 90°. In FIG. 1, the center fold, line 11–12, is depicted as a crisp line approximately midway between the two side panels 10 and 17 of the flashing 14. No such limitation exists in the invention as the directional vanes, ribbing, scoring or etchings 16*a*–16*h* on the working surface of the flashing 14 will effectively direct the flow of accumulated moisture even if the flashing 14 is semi-circular, in which case no center fold, line 11–12, would exist. The essence of the invention being the positioning of the directional vanes, ribbing, scoring or etchings 16*a*–16*h* on the working surface of a flashing 14 such that the flow of accumulated moisture is directed inwardly toward the interior of the flashing 14 and toward a moisture discharge point rather than toward the exterior of the flashing 14 and subsequently out of the flashing 14 into the surrounding building structure.

In FIG. 1, the shower tub 20 depicted provides a shower tub floor 23 having a drain 24 in it, and a shower tub rim or wall which provides an interior right hand wall 22, an interior left hand wall 25 and a top of right hand wall 21 and a top of left hand wall 26. The flashing 14 depicted in FIG. 1 provides a center fold line 13, defined as being between points 11 and 12, a right hand panel having interior surface 10, and a left hand panel having interior surface 17. Interior surfaces 10 and 17 each provide directional vanes, ribbing, scoring or etchings 16*a*–16*h* which, when the flashing 14 is stood in an upright, vertical position, are at a higher elevation close to the edge of the flashing 14 and depend generally toward a lower elevation as they track toward the center or interior of the flashing 14. The center or interior of the flashing 14 is, in the preferred embodiment depicted in FIG. 1, demarcated by the center fold line 13.

The value of the directional vanes, ribbing, scoring or etchings 16*a*–16*h* is readily understood when it is considered that when placed in the vertical position the flashing 14, of the preferred embodiment depicted in FIG. 1, may be considered as simply two flat panels joined at the center fold line 13. The action of accumulated moisture on a flat vertical panel is to form rivulets or streams depending downwardly, but randomly taking direction to the right or left. The random change of direction of the rivulets of accumulated moisture to the right or left is, in the absence of the application of external forces, controlled by the random occurrence of imperfections in the surface of the flat vertical panel.

Figure 2:
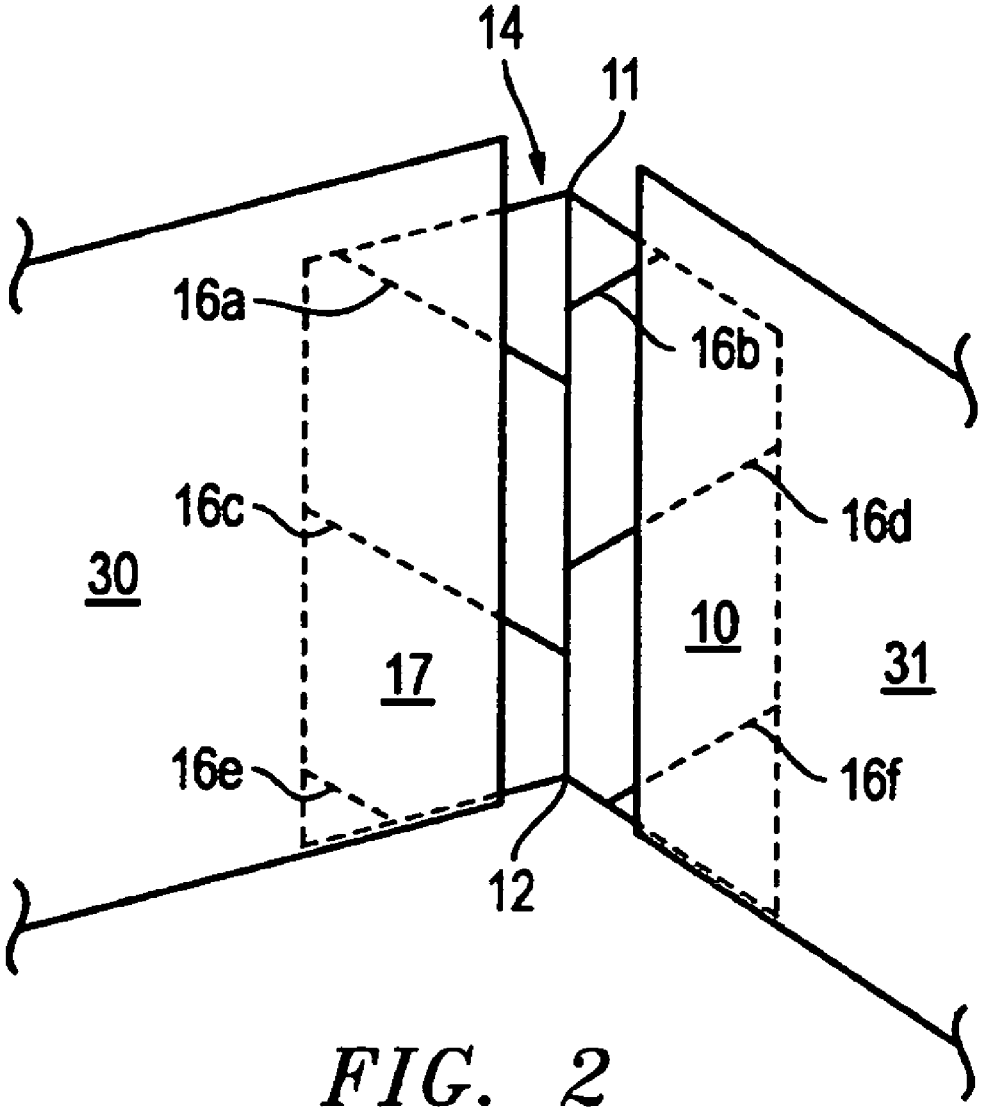
FIG. 2 is a perspective view of the flashing of the instant invention positioned vertically behind two vertical walls of a shower enclosure.

In FIG. 2, the flashing 14 of the preferred embodiment is depicted as vertically positioned behind two flat vertical walls 30 and 31. The walls 30 and 31 are the vertical walls of a shower tub enclosure. Normally, the walls 30 and 31 would have tiles or texturing placed over their interior, facing inwardly to the shower tub enclosure and away from the building materials surrounding the shower tub enclosure. Further, the vertical walls 30 and 31 would normally be positioned vertically within the shower tub 20, with the rear surface of the vertical walls 30 and 31 abutting the interior of the shower tub walls 22 and 25, respectively.

Figure 3:
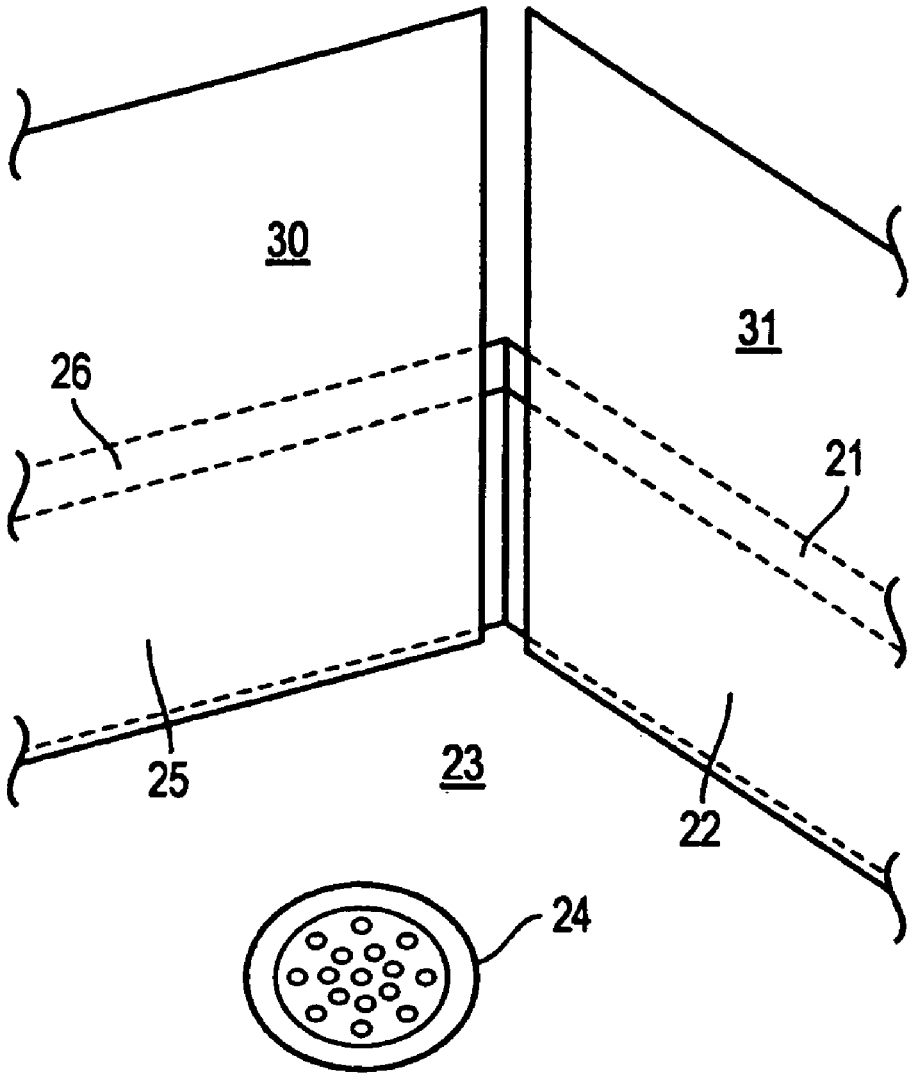
FIG. 3 is a perspective two vertical walls of a shower enclosure positioned vertically in a shower tub.

FIG. 3 depicts the rear surface of the vertical walls 30 and 31 abutting the interior of the shower tub walls 22 and 25. As seen in FIG. 3, the rear surface of the vertical wall 31 abuts the interior surface of the shower tub wall 22 and the rear surface of the vertical wall 30 abuts the interior surface of the shower tub wall 25 when, as in the preferred embodiment, the vertical walls 30 and 31 are positioned vertically upon the shower tub floor 23 within the shower tub 20. This positioning permits the normal shower water runoff to be back into the shower tub 20, onto the shower tub floor 23 and down the shower tub drain 24.

Figure 4:
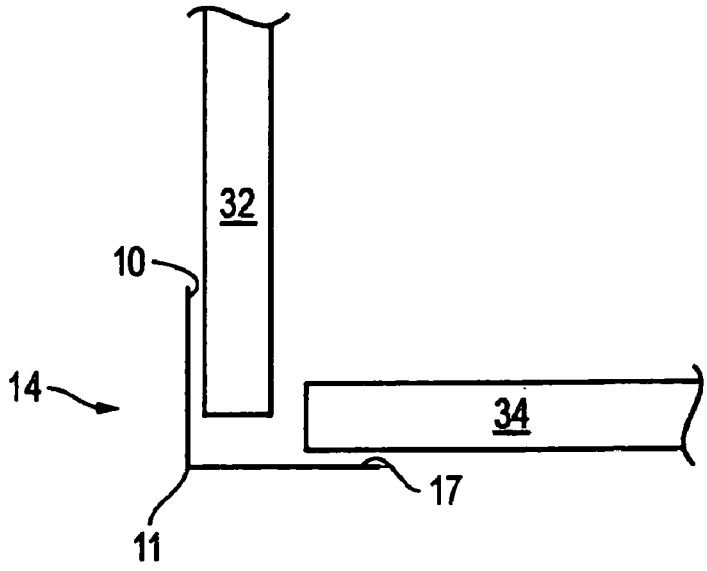
FIG. 4 is a horizontal plane view of the flashing of the instant invention positioned behind a building's second story siding and beneath the building's first story roofing tiles.
Figure 5:
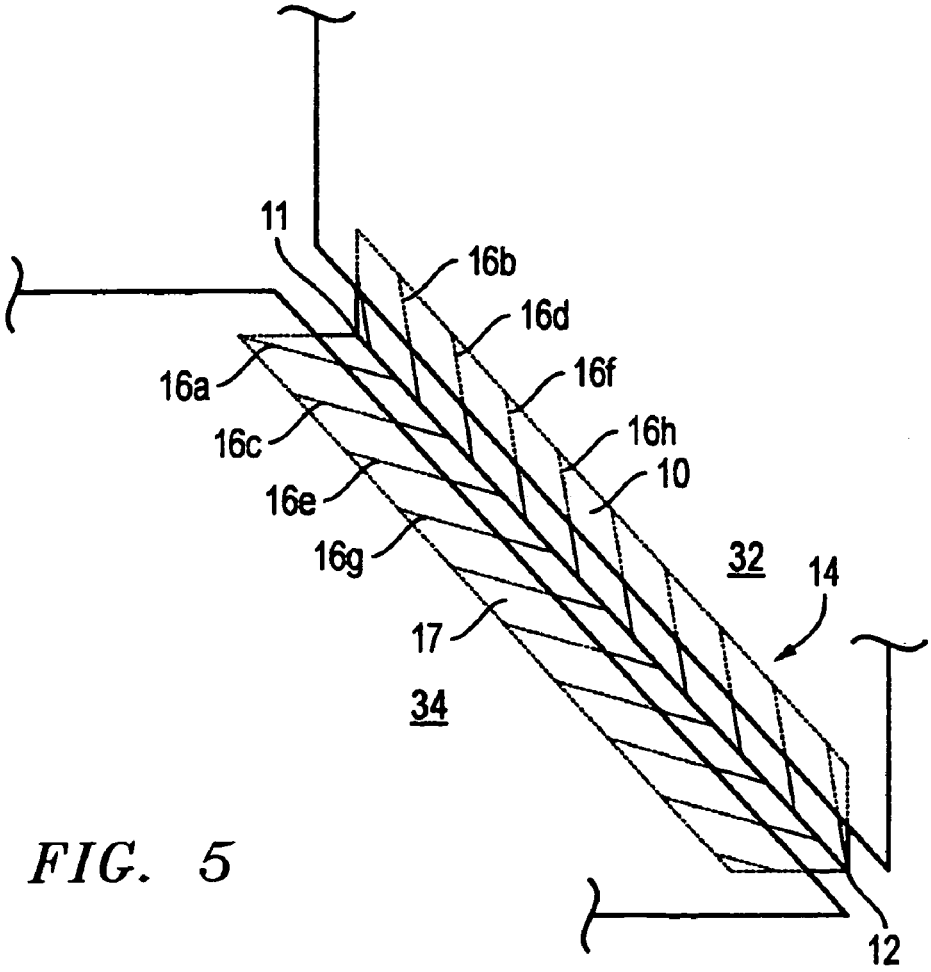
FIG. 5 is a perspective view of the flashing of the instant invention positioned behind a building's second story siding and beneath the building's first story roofing tiles.

FIG. 4 and FIG. 5 depict the use of the flashing 14 of the instant invention in another common application. In FIG. 4 and FIG. 5 the flashing 14 is placed behind the siding material 32, such that the interior of the right panel 10 of the flashing 14 is between the second story building structure and the siding material 32 on the exterior of the building structure; and the interior of the left panel 17 of the flashing 14 is beneath the roofing material 34 or tiles on the first story of the building structure. In FIG. 5 is seen the directional vanes 16*a*–16*h* on the flashing 14 which will, even if the roofing material 34 is at a very nominal angle to the horizontal, function to direct the flow of water or other moisture leaking, seeping, or otherwise permeating through the joinder between the siding material 32 and the roofing material 34 provided that the top 11 of the center fold of the flashing 14 is elevated to a height above the bottom 12 of the center fold of the flashing 14. Again, by producing directional flow of moisture on the working surface of the flashing 14 the directional vanes 16*a*–16*h* cause the accumulated rivulets of moisture to flow toward the center, line 11–12, of the flashing 14 rather than outwardly away from the center of the flashing 14 and into the structural components of the building.

The composition of the directional vanes 16*a*–16*h* can vary widely. The directional vanes 16*a*–16*h* may consist simply of areas of surface imperfection on the interior or working surfaces 10 and 17 of the flashing 14. Or, the directional vanes 16*a*–16*h* may be adhered strips of material; or may be indentures or ridges formed in a sheet material, perhaps metal, which is cut to length in order to create the flashing 14.

There is, as seen in FIG. 3, however, the problem well-documented in the prior art of water seepage or leakage through the crack formed in the joint between the two vertical walls 30 and 31. This raises the need for the placement of the flashing 14 of the instant invention behind the two vertical walls 30 and 31, as depicted in FIG. 2. Placement of the flashing 14 behind the two vertical walls 30 and 31 causes the water which leaks through the joint between the two vertical walls 30 and 31 to form rivulets and stream downwardly along the center fold line 13 of the flashing 14 to the shower tub floor 23 and hence to the shower tub drain 24, without leakage of moisture around the flashing 14 into the building materials surrounding the shower tub enclosure.

In use, the flashing 14 is not adhesively attached to the vertical walls 30 and 31, although spots of adhesive may be used to attach the flashing 14 to the vertical walls 30 and 31 or the flashing 14 may be attached by wood screw or other mechanism which does not fill in the spaces on the interior surfaces of the flashing 14 and thereby destroy the effect of the directional vanes, ribbing, scoring or etchings 16*a*–16*h* in forming surface rivulets of moisture flowing downwardly and toward the center of the flashing 14.

In practice, the actual number of directional vanes, ribbing, scoring or etchings 16*a*–16*h* placed on the working surfaces of the flashing 14 may vary widely and still be effective. Placement of the directional vanes, ribbing, scoring or etchings 16*a*–16*h* on the interior surfaces of the flashing 14 should, in order to be most effective, be such that each of the directional vanes, ribbing, scoring or etchings 16*a*–16*h* begins at or near an edge of the flashing 14 and proceeds in a direction which is downwardly once the flashing 14 is placed in position for use and in a direction which is away from the edge of the flashing 14 and toward the center or interior of the flashing 14. This will ideally cause the rivulets formed to be flowing away from the edges of the flashing 14 and downwardly toward the center or interior of the flashing 14.

Notice that the directional elements are described as directional vanes, ribbing, scoring or etchings 16*a*–16*h*. This is because the rivulets of moisture formed on the flashing 14 when in its vertical position are directed in their flow by disturbances or imperfections in the interior surface of the flashing 14. Accordingly, while the directional vanes, ribbing, scoring or etchings 16*a*–16*h* may be either features which arise from the working surface of the flashing 14 or features which are cut into the working surface of the flashing 14, such features do not need to be large and may be such as only constitutes a, or a series of, designed directional defect(s) in the surface of the working surface of the flashing 14.

Optimal ratios of vane height, vane spacing, vane downward angle and flashing interior panel 10 or 17 size can be found for various expected moisture flow rates down the flashing 14 to the shower tub floor 23. Likewise, it is expected that optimal ratios would exist for ribbing, scoring or etching of the interior surface of the flashing 14. A second embodiment of the instant invention utilizes vanes and/or ribs that are of greater height nearer the edges of the flashing 14 and, likewise, deeper and/or wider scorings and/or etchings near the edges of the flashing 14. This varying height or depth of the directional elements accommodates a greater range of moisture accumulation rates on the working surfaces of the flashing 14 than does a uniformly small height or depth of the directional elements.

It is of the essence of the instant invention that the directional elements, which are the vanes, ribbing, scoring or etchings on the working surface of the flashing 14, cause directional flow of rivulets of moisture due to gravitational forces. Thus, to be effective, each directional element must start at a point of maximum elevation from the ground and progressively provide a lower elevation path to or toward that point at which discharge of the moisture rivulets from the working surface of the flashing 14 is desired.

The actual shape of the flashing 14 is not significant to the instant invention as disk-shaped, semi-conical, semi-cylindrical, square, rectangular with rounded corners, and wholly irregular shapes are anticipated for flashings 14 adapted for specialized uses. In all cases, however, the directional elements on the working surface of the flashing 14 provide directional flow to the rivulets of accumulated moisture on the working surface of the flashing 14 by beginning at a higher elevation in the region of the working surface from which moisture is taken and proceeding progressively to lower elevations toward the point of moisture discharge from the working surface.

While the preferred embodiments of the instant invention have been described in substantial detail and fully and completely hereinabove, it will be apparent to one skilled in the art that numerous variations of the instant invention may be made without departing from the spirit and scope of the instant invention, and accordingly the instant invention is to be limited only by the following claims.

I claim:

1. A flashing which provides directional vanes, ribbing, scoring or etchings on its working surface, said working surface being on only one side of said flashing, wherein said working surface is flat and provides an upper horizontal edge, a lower horizontal edge, a right vertical edge, a left vertical edge, a center fold, and said directional vanes, ribbing, scoring or etchings progress across said working surface downwardly away from said lateral edges toward said center fold;

whereby accumulated moisture on said working surface is caused to flow over said working surface toward a point of discharge from said flashing.

* * * * *